US007815128B2

(12) United States Patent
Beilharz et al.

(10) Patent No.: US 7,815,128 B2
(45) Date of Patent: Oct. 19, 2010

(54) METHOD AND INJECTION SYSTEM FOR INJECTING A FLUID

(75) Inventors: Jörg Beilharz, Berlin (DE); Nicholas Nozeran, Regensburg (DE); Richard Pirkl, Regensburg (DE); Christian Riβler, Berlin (DE); Harald Schmidt, Vienna (AT); Hans-Jörg Wiehoff, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 399 days.

(21) Appl. No.: 11/755,018

(22) Filed: May 30, 2007

(65) Prior Publication Data

US 2008/0087748 A1 Apr. 17, 2008

(30) Foreign Application Priority Data

Oct. 17, 2006 (DE) ..... 10 2006 048 979

(51) Int. Cl.
*F02D 1/06* (2006.01)

(52) U.S. Cl. ..... 239/5; 239/4; 239/102.2; 239/533.4; 239/584; 123/299; 123/498

(58) Field of Classification Search ..... 239/4, 239/5, 102.1, 102.2, 533.3, 533.4, 533.5, 239/533.12, 584; 123/299, 496, 498, 674
See application file for complete search history.

(56) References Cited

U.S. PATENT DOCUMENTS

| | | | | |
|---|---|---|---|---|
| 6,412,704 | B2 * | 7/2002 | Shinogle et al. | 239/5 |
| 6,619,268 | B2 * | 9/2003 | Rueger et al. | 123/498 |
| 6,896,208 | B2 * | 5/2005 | Kuegler | 239/533.4 |
| 7,021,278 | B2 * | 4/2006 | Ishizuka et al. | 123/299 |
| 7,188,788 | B2 * | 3/2007 | Augustin | 239/102.2 |
| 7,258,283 | B2 * | 8/2007 | Heinz et al. | 239/102.2 |
| 2006/0082252 | A1 | 4/2006 | Allmendinger et al. | |

FOREIGN PATENT DOCUMENTS

| | | | |
|---|---|---|---|
| DE | 10310120 | A1 | 9/2004 |
| DE | 10345226 | A1 | 5/2005 |
| DE | 102004023545 | A1 | 12/2005 |

OTHER PUBLICATIONS

German Office Action, German application No. 10 2006 048 979.9-26, 2 pages, Mar. 12, 2007.

* cited by examiner

*Primary Examiner*—Steven J Ganey
(74) *Attorney, Agent, or Firm*—King & Spalding L.L.P.

(57) ABSTRACT

A method for injecting a fluid, in particular a fuel, performs the following steps: A nozzle (1) which can be actuated by a piezo element (5) is provided. A current pulse (12*a*) is supplied to the piezo element (5). The capacity (16) of the piezo element (5) is recorded at the time when the current pulse (12*a*) is supplied. An actual characteristic curve of the injection is recorded based on the capacity (16). The current pulse (12*a*) is regulated in order to optimize the injection based on the actual characteristic curve of the injection.

15 Claims, 5 Drawing Sheets

METHOD AND INJECTION SYSTEM FOR INJECTING A FLUID

CROSS-REFERENCE TO RELATED APPLICATIONS

This application claims priority from German Patent Application No. 10 2006 048 979.9, which was filed on Oct. 17, 2006, and is incorporated herein by reference in its entirety.

TECHNICAL FIELD

The present invention relates to a method for injecting a fluid, in particular a fuel, through a nozzle. The present invention further comprises an injection system for performing the method according to the invention.

BACKGROUND

The fuel consumption and emission values of modern combustion engines are substantially influenced by the time of injection and the duration of the injection of the fuel into combustion cylinders of the combustion engine. Complete combustion is guaranteed only if, inter alia, the same quantity of fuel is injected into all of the combustion cylinders. Otherwise there is an increased discharge of unburnt hydrocarbons.

Furthermore the injection must be executed in accordance with a predefined timing cycle. If an injection deviates from this timing cycle, this leads to misfires which the driver perceives as unpleasant jerking, in particular when the engine is idling.

For this reason engine management systems are provided in conjunction with injection valves which precisely control both the injection point and the injection duration or, as the case may be, the end of the injection.

Injection valves having pump-nozzle systems store fuel in the injection valve under high pressure. For an injection period a nozzle valve is opened and some of the fuel is injected out of the injection valve.

Due to manufacturing factors the injection valves exhibit different injection characteristics. These differences are accepted as tolerances, since a more precise manufacture of the injection valves would lead to disproportionately high overheads. On the other hand these tolerances are a contributory factor to the less than optimal operation of the combustion engines.

SUMMARY

There exists a need to provide a means of control which reduces the fuel consumption and pollutant emissions of a combustion engine.

According to an embodiment, a method for injecting a fluid is provided. Toward that end the method may provide the following steps:

(a) provide at least one nozzle which can be actuated by means of a piezo element, (b) supply a current pulse to the piezo element, (c) record the capacity of the piezo element when the current pulse is supplied, (d) record an actual characteristic curve of the injection based on the capacity, (e) regulate the current pulse in order to optimize the injection based on the actual characteristic curve of the injection.

A device according to an embodiment for injecting a fluid may comprise:

a nozzle which can be actuated by means of a piezo element, a control device which outputs a predefined current pulse to the piezo element in order to inject a fluid by means of the nozzle from a predefined start to a predefined end, a capacity recording device which records a capacity of the piezo element, and a regulating device which adjusts the predefined current pulse to an actual characteristic curve based on the capacity.

BRIEF DESCRIPTION OF THE DRAWINGS

The present invention is explained below with reference to a preferred embodiment and accompanying figures, in which.

DETAILED DESCRIPTION

According to an embodiment, the actual characteristic curve is precisely recorded, i.e. above all the start and the actual end of an injection process. The current pulse can then be adjusted such that the actual start and end of injection corresponds to the predefined start and end of injection.

According to one embodiment, an actual start of injection is recorded as a first instant in time at which the capacity exceeds a threshold value. The capacity increases in a characteristic manner when the nozzle opens and the piezo element extends.

According to one embodiment an actual end of injection is recorded as a second instant in time at which the capacity falls below a second threshold value. The recoiling of the nozzle needle when the nozzle is closed compresses the piezo element, whereupon the latter's capacity decreases in a characteristic manner.

In a further development the following steps are provided: record a voltage which drops across the piezo element, record an actual end of injection after the current pulse has been supplied as a second instant in time at which the voltage assumes a maximum. The recoiling of the nozzle needle leads in a characteristic manner to a voltage peak at the piezo element.

According to one embodiment the difference between a predefined start of injection and the actual start and/or a difference between a predefined end of injection and the actual end is determined during a pre-injection and the difference is used for adjusting a further current pulse for the main injection.

In one embodiment the current pulse is adjusted individually for each of the one or more nozzles.

In one embodiment the nozzle is opened only partially by means of the current pulse in order to inject only a minimum quantity of fuel.

Figure 1:
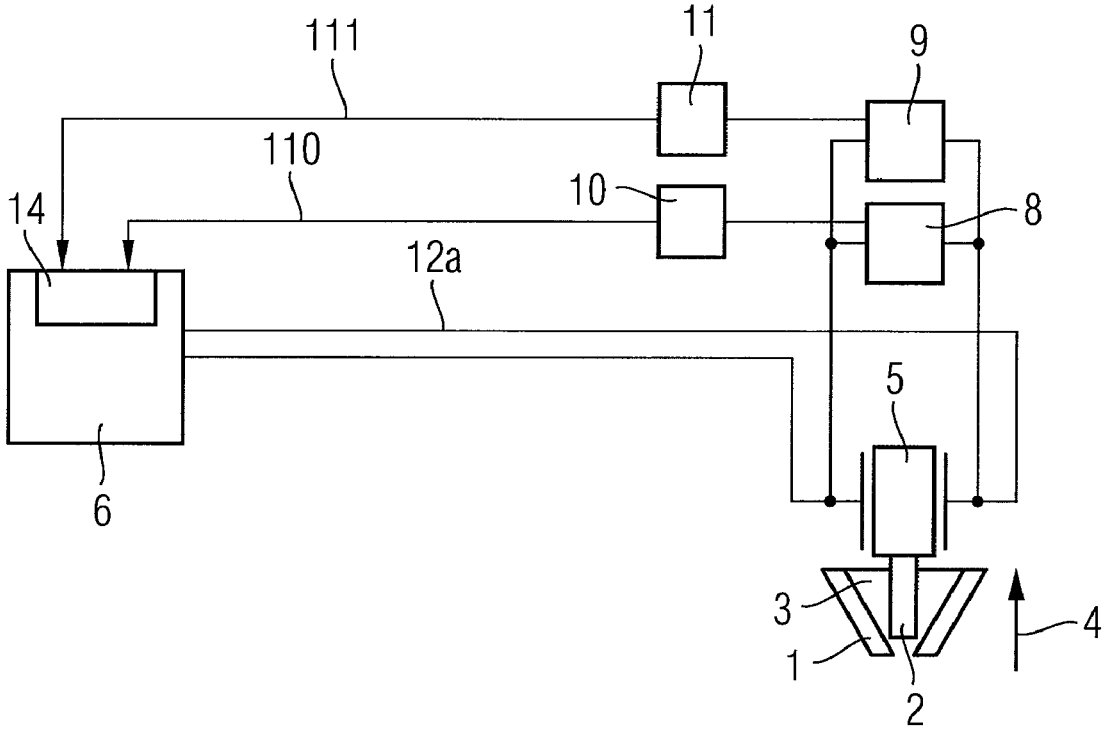
FIG. 1 is a block diagram of an embodiment of an injection system.
Figures 2A, 2B, 2C, 2D, 2E:
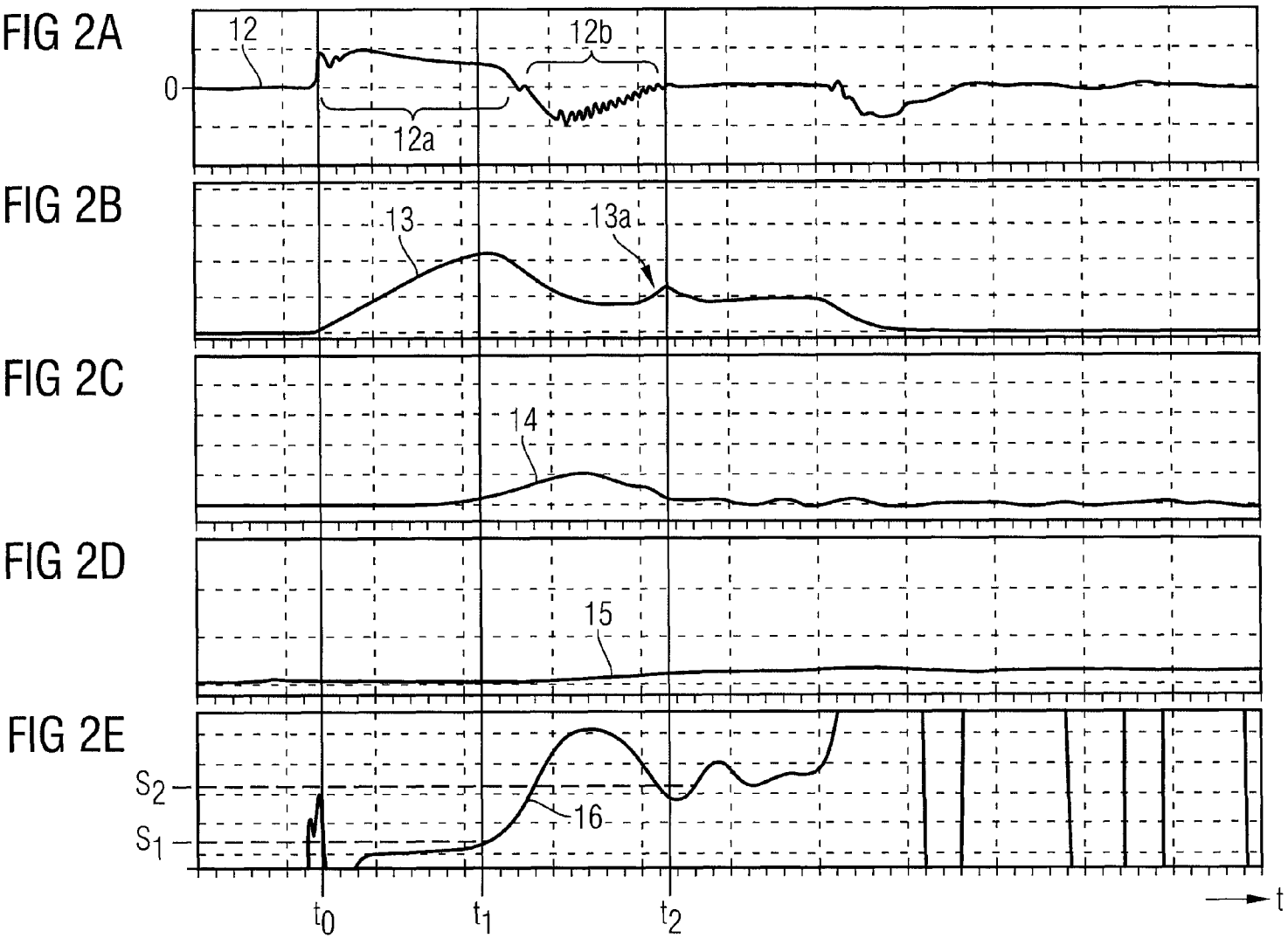
FIGS. 2*a*-2*e* show signal characteristic curves for the purpose of explaining the embodiment from FIG. 1.

FIG. 1 shows a schematic of one embodiment. A nozzle 1 is represented schematically with its nozzle needle 2. Its functional principle is that a fuel is provided under high pressure in the volume 3. The nozzle needle 2 can be moved upward by means of a suitable mechanism and lever elements, as indicated by the arrow 4. The nozzle needle 2 thus no longer blocks the aperture of the nozzle 1 and the fuel in the volume 3 is able to escape. A more detailed explanation of the mechanics of the nozzle 1 is presented later with reference to FIG. 6.

The nozzle needle 2 is actuated mechanically by means of the piezo element 5. The piezo element 5 is fabricated from a piezoelectrically active material which extends measurably when a voltage is applied. The travel achieved thereby is sufficient to move the nozzle needle 2 away from the aperture of the nozzle 1.

The rest position of the piezo element, that is to say when no voltage is applied to the piezo element, is designed such that in this case the nozzle needle 2 closes the nozzle 1. In a particularly preferred variant the nozzle 1 is closed even when a small bias voltage of a few volts is present at the piezo element 5, for example due to residual charges. This has the advantage that the piezo element 5 does not have to be completely discharged in order to close the nozzle 1 completely.

The piezo element 5 is activated by means of a control device 6. In accordance with a predefined injection cycle the control device 6 outputs current pulses 12*a* which charge the electrodes of the piezo element 5. The voltage drop across the electrodes generated thereby causes the piezo element 5 to extend and the nozzle needle 2 to be lifted. The nozzle 1 is actively discharged by means of a further current pulse 12*b* with opposite polarity to the current pulse 12*a*. This causes the piezo element 5 to relax into an intermediate position. At the same time the nozzle needle 2 drops. The mechanical arrangement of the nozzle 1 is advantageously designed in such a way that the nozzle 1 is already closed by means of the nozzle needle 2 when the piezo element 5 assumes the intermediate position.

It is shown that after the current pulse 12*b*, i.e. in the intermediate position, small residual charges remain in the piezo element 5 which would take a long time to dissipate. There is therefore a small voltage drop across the piezo element 5 and the piezo element 5 has not completely relaxed to its minimum extension. In order to achieve a complete contraction of the piezo element 5, the residual charges are discharged by shorting of the contacts of the piezo element. The nozzle needle 2 thereupon moves to its rest position.

The residual charges can be discharged after a freely selectable period of time has expired. In this case, however, it is essential that the nozzle 1 is already closed when in the intermediate position.

The nozzle 1 and the piezo element 5 and the surrounding devices of the combustion engine are subject to high mechanical and thermal stress. This causes a shift in the characteristic curves of the piezo element 5 as well as the exact distances that the nozzle needle 2 has to travel in order to open or, as the case may be, close the nozzle 1. For this reason an identical current pulse output by the control device 6 leads to a different injection behavior while the engine is running. The duration of the injection period and the start of injection in particular are influenced thereby.

In the following it will be explained how the start of injection and the end of injection can be recorded by means of the capacity recording device 8 and the voltage recording device 9.

The capacity recording device 8 is connected to the electrodes of the piezo element 5. The capacity of the piezo element 5 can be measured by means of differential capacity determination. For this purpose a modulation is superimposed onto the current pulse and the synchronized detected voltage change across the electrodes recorded. Other methods of determining capacity can also be used.

The voltage recording device 9 is likewise connected to the electrodes of the piezo element 5. The capacity recording device 8 and the voltage recording device 9 are preferably arranged close to the piezoelectric element 5, that is to say integrated in the injection valve. It is, however, equally possible to integrate the two recording devices 8, 9 in the control device 6.

FIGS. 2*a* to 2*e* show by way of example a current 12 into the piezo element 5, a characteristic curve of a supplied current pulse 12*a*, of the voltage drop 13 across the electrodes of the piezo element 5, a fuel injection quantity per time unit 14, a fuel quantity 15 in the injection valve, and the capacity 16 of the piezo element over time t.

The start of the current pulse 12 for the purpose of initiating the injection is the time t0. From FIG. 2*b* it is clear that from this time t0 a voltage builds up across the electrodes of the piezo element 5. From time t1 the voltage 13 is large enough to open the nozzle 1.

The mechanical stress on the piezo element 5 increases from time t0 to time t1. The mechanical stress is reduced when the nozzle 1 opens. During the high mechanical loading until the nozzle opens the piezo element 5 has only a small capacity. After the piezo element 5 has mechanically relaxed, its capacity increases to a multiple, as is clearly to be seen between times t1 and t2. The start of injection can therefore be identified as time t1 at which the capacity increases sharply or exceeds a threshold value S1.

At the end of injection the nozzle needle 2 strikes the nozzle 1. The reactive force or acceleration resulting therefrom is transferred to the piezo element 5. The piezo element 5 reacts to this force by forming a voltage 13 between the electrodes. The resulting voltage peak 13*a* can be recognized at time t2 in FIG. 2*b*. Conversely, the end of injection is detected by the determining of a maximum in the voltage 13. All that is of interest in this instance is a maximum which occurs after the current pulse 12*a* for activating the piezo element 5.

In another embodiment the end of injection is recorded via the capacity 16. The recoiling nozzle needle increases the mechanical loading on the piezo element 5. This leads to a reduction in capacity for the time of striking. In the depicted characteristic curve of the capacity 16 a corresponding minimum can also be identified at the time of closing t2. The end of injection is thus detected by comparison of the capacity with a second threshold value S2. If the capacity falls below the threshold value S2, after the capacity previously exceeded the threshold value S1, the associated time t2 is assumed as the end of injection.

The method for determining the start of injection and the end of injection is of exceptional importance in particular for what is referred to as a ballistic injection. By a ballistic injection is meant that a short current pulse 12*a* flows into the piezo element 5 from the control device 6, which current pulse serves to briefly open the nozzle 2. The nozzle needle 2 is in permanent movement during the injection. The term "ballistic" is based on a ball which is thrown up into the air and on which a force is exerted once at the beginning in order to accelerate it upward against the gravitational field and which is gradually slowed down by the gravitational field and accelerated again back to the ground. Minimal fuel quantities can be injected into the combustion chamber by means of the ballistic injection technique.

The capacity recording device 8 outputs a signal corresponding to the measured capacity to a threshold value device 10. The threshold value device 10 compares the capacity with a threshold value and transmits a first trigger signal 110 to the control device 6 if the threshold value is exceeded. In this way the control device 6 can detect the start of injection.

Connected downstream of the voltage recording device 9 is a peak detection device 11 which outputs a second trigger signal 111 when the voltage assumes a maximum. The control device 6 records the end of injection by means of this second trigger signal 111. The control device 6 preferably has a plausibility monitoring device which detects whether the maximum of the voltage is to be attributed to the recoiling of the nozzle needle or whether a maximum of some other type is involved here. In particular the maximum at the start of the actuation of the piezo element 5 and during the supplying of the current pulse are suppressed.

Figure 3:
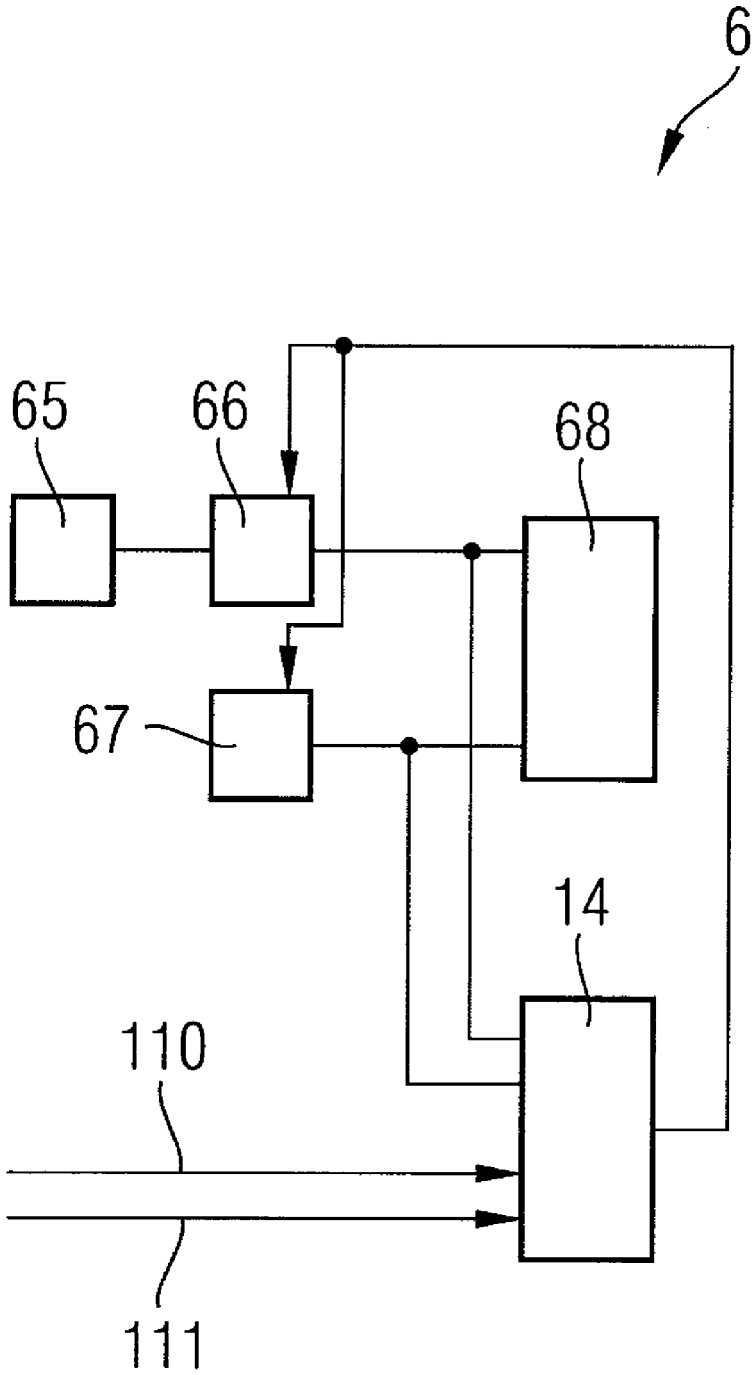
FIG. 3 is a block diagram of a detail of the embodiment from FIG. 1.

FIG. 3 shows a more detailed representation of the control device 6 in the form of a block diagram. The control device 6 has an injection quantity calculating unit 65. This determines what injection quantity is necessary for the operation of an engine and the respective cylinders. From the injection quantity, an injection period calculating unit 66 determines the associated injection period. An injection time calculating device 67 determines the time, that is to say the start of the injection. The data processing device processes the injection time and the injection period in order to calculate a suitable current pulse 12*a* that is to be supplied to the piezo element 5.

The currently predefined injection time and the currently determined injection period are fed to a regulating device 14. The regulating device 14 also receives the trigger signals 110, 111. The actual injection parameters (start, end and duration) are determined from the trigger signals 110, 111. The regulating device 14 determines the difference between the currently predefined injection parameters and the actual injection parameters. The difference is fed to the injection period calculating unit 66 and the injection time calculating device 67. The injection period calculating device 66 and the injection time calculating device 67 take these differences into account for the injection periods and injection times that are to be determined subsequently. By this means a regulation of the injection period and the injection time to the optimal target values is guaranteed.

The injection period and the injection time are preferably adjusted individually for the individual injection valves.

Figure 4A:
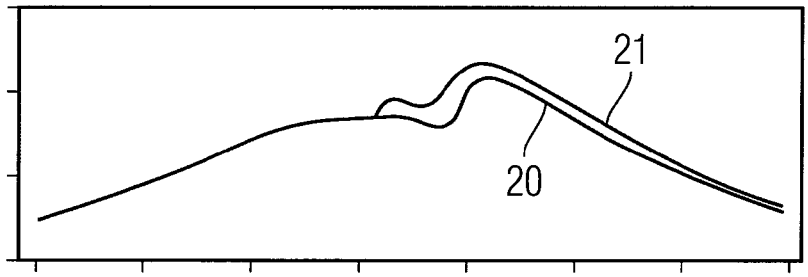
FIGS. 4*a*, 4*b* show signal characteristic curves without the use of the embodiment.
Figure 4B:
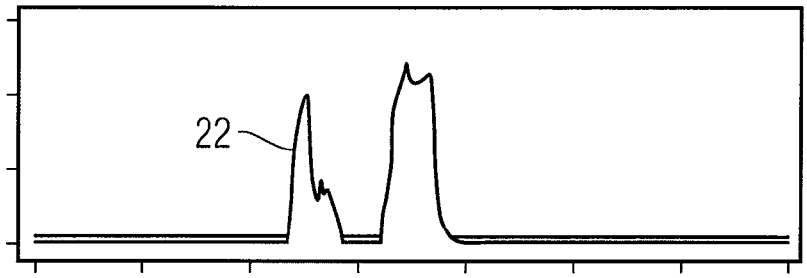

FIGS. 4*a* and 4*b* show the injected quantity 20, 21 for two cylinders. The same current pulse 12*a* is sent in each case to the piezo elements 5 of the two injection valves. A difference in the injected quantity results due to slightly different properties of the two injection valves, as can be seen in FIG. 4*a*.

Following an adjustment in accordance with the previously described method and the embodiment an identical injection quantity 23 is injected by both injection valves. The driving current pulses 24, 25 are now different for the two injection valves or, as the case may be, their piezo elements 5.

Figure 5A:
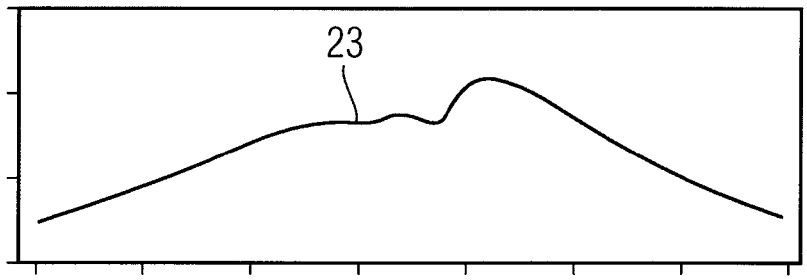
FIGS. 5*a*, 5*b* show signal characteristic curves with the use of the embodiment.
Figure 5B:
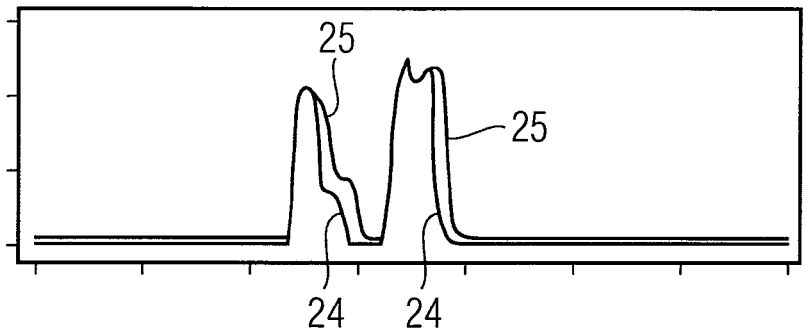

The pattern of the current pulse shown in FIGS. 4 and 5*b* corresponds to a pre-injection and a main injection. The correction values for the injection period and the injection time can be determined already during the pre-injection. This will possibly result in further slight differences in the quantity during the pre-injection. However, the main injection takes place already in accordance with the desired optimal parameters.

Figure 6:
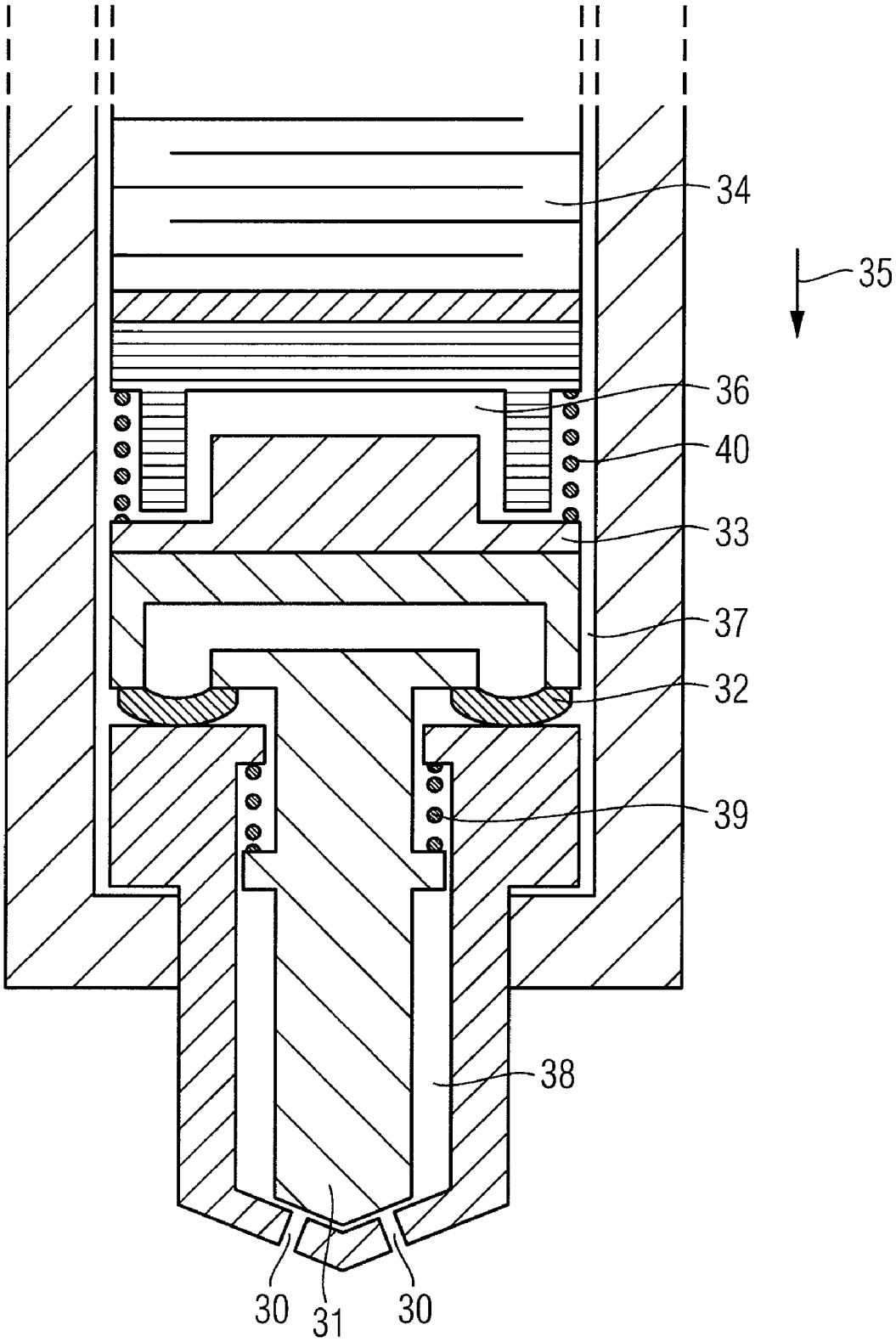
FIG. 6 shows a nozzle for use with the embodiment.

FIG. 6 shows a possible embodiment of an injection valve which can be used for the above-cited embodiment. The injection valve has nozzle apertures 30 which are closed by a nozzle needle 31. The nozzle needle is mechanically connected via rockers 32 in the piston 33. The piezo element 34 extends in direction 35, that is to say in the direction of the piston 33, when a voltage is applied to the piezo element. This voltage can be built up for example by the previously described current pulses. A cavity 36 filled with fuel may be disposed between the piezo element 34 and the piston 33. The continuous space, identified by the reference numerals 36, 37 and 38, is filled with a liquid fuel. The fuel is preferably under high pressure, e.g. 2000 bar.

The mode of operation of the illustrated injection valve is as follows: In a relaxed situation, that is to say when a voltage or only a small bias voltage is present at the piezo element 34, the nozzle needle 31 closes the nozzle apertures 30. A corresponding closing force can be provided by springs 39 and 40. When a current pulse 12*a* flows into the piezo element 34, said piezo element 34 presses the piston 33 in the direction of the nozzle apertures 30. The rockers 32 redirect the pressure into a force that operates in the opposite direction and lifts the needle 31. At this moment in time the nozzle apertures 30 are open. As a result the fuel, which is under high pressure, is discharged from the nozzle into the combustion chamber.

Although the present invention has been described with reference to a preferred embodiment, it is not restricted thereto. The method and the device are also suitable in particular for injection systems in metering systems for the chemical industry.

What is claimed is:

1. A method for injecting a fluid comprising the steps of:

providing at least one nozzle which can be actuated by means of a piezo element for an injection process including a pre-injection and a main injection, and during the pre-injection:

supplying a current pulse to the piezo element, recording the capacity of the piezo element when the current pulse is supplied, recording an actual characteristic curve of the pre-injection based on the capacity, determining, based on the actual characteristic curve of the pre-injection, at least one of (a) an actual start of the pre-injection, (b) an actual end of the pre-injection, and (c) an actual duration of the pre-injection, determining one or more difference values for at least one of (a) a difference between a predefined start of the pre-injection and the actual start of the pre-injection, (b) a difference between a predefined end of the pre-injection and the actual end of the pre-injection, and (c) a difference between a predefined duration of the pre-injection and the actual duration of the pre-injection, based on the one or more difference values, determining one or more correction values for at least one of (a) an injection start time for the main injection, (b) an injection end time for the main injection, and (c) an injection period for the main injection, and adjusting a further current pulse for the main injection based on the one or more correction values.

2. The method according to claim 1, wherein the fluid is fuel.

3. The method according to claim 1, wherein the actual start of the pre-injection is recorded as a first instant in time at which the capacity exceeds a threshold value.

4. The method according to claim 3, wherein the actual end of the pre-injection is recorded as a second instant in time at which the capacity falls below a second threshold value.

5. The method according to claim 1, comprising the further steps of:

recording a voltage which drops across the piezo element, and recording the actual end of the pre-injection after the current pulse has been supplied as a instant in time at which the voltage assumes a maximum.

6. The method according to claim 1, wherein the further current pulse for the main injection is adjusted individually for each nozzle.

7. The method according to claim 1, wherein the nozzle is opened only partially by means of the current pulse in order to inject only a minimum quantity of fuel.

8. The method according to claim 1, wherein the further current pulse for the main injection defines the injection start time and the injection start time for the main injection.

9. An injection system for injecting a fluid, comprising:

a nozzle which is actuated by a piezo element, a control device which outputs a predefined current pulse to the piezo element in order to inject a fluid by the nozzle for a pre-injection and a main injection, a capacity recording device which records an actual characteristic curve of a capacity of the piezo element during a pre-injection, a regulating device which, during the pre-injection:

determines, based on the actual characteristic curve of the capacity of the piezo element during the pre-injection, at least one of (a) an actual start of the pre-injection, (b) an actual end of the pre-injection, and (c) an actual duration of the pre-injection, and determines difference values for at least one of (a) a difference between a predefined start of the pre-injection and the actual start of the pre-injection, (b) a difference between a predefined end of the pre-injection and the actual end of the pre-injection, and (c) a difference between a predefined duration of the pre-injection and the actual duration of the pre-injection, one or more calculating devices that, during the pre-injection:

determines one or more correction values for at least one of (a) an injection start time for the main injection, (b) an injection end time for the main injection, and (c) an injection period for the main injection, and a data processor that adjusts a predefined current pulse for a further current pulse for the main injection based at least on the one or more correction values determined during the pre-injection.

10. The system according to claim 9, wherein the fluid is fuel.

11. The system according to claim 9, wherein the actual start of the pre-injection is recorded as a first instant in time at which the capacity exceeds a threshold value.

12. The system according to claim 11, wherein the actual end of the pre-injection is recorded as a second instant in time at which the capacity falls below a second threshold value.

13. The system according to claim 9, wherein the further current pulse for the main injection is adjusted individually for each nozzle.

14. The system according to claim 9, wherein the nozzle is opened only partially by means of the current pulse in order to inject only a minimum quantity of fuel.

15. The system according to claim 9, wherein the further current pulse for the main injection defines the injection start time and the injection start time for the main injection.

* * * * *